US011156175B1

(12) United States Patent
Dudar

(10) Patent No.: US 11,156,175 B1
(45) Date of Patent: Oct. 26, 2021

(54) VEHICLE WITH A DUAL PATH EVAPORATIVE EMISSIONS SYSTEM

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/142,523

(22) Filed: Jan. 6, 2021

(51) Int. Cl.

| | |
|---|---|
| ***F02D 41/06*** | (2006.01) |
| ***F02M 25/08*** | (2006.01) |
| ***F02D 41/00*** | (2006.01) |
| ***F02D 41/04*** | (2006.01) |

(52) U.S. Cl.
CPC ..... *F02D 41/004* (2013.01); *F02D 41/042* (2013.01); *F02D 41/062* (2013.01); *F02M 25/089* (2013.01); *F02M 25/0836* (2013.01); *F02D 2200/101* (2013.01); *F02D 2250/41* (2013.01); *F02M 2025/0863* (2013.01)

(58) Field of Classification Search
CPC .... F02D 41/004; F02D 41/042; F02D 41/062; F02D 2250/41; F02D 2200/101; F02M 25/0836; F02M 25/089; F02M 2025/0863
See application file for complete search history.

(56) References Cited

U.S. PATENT DOCUMENTS

| | | | | |
|---|---|---|---|---|
| 6,688,104 | B2 | 2/2004 | Baeuerle et al. | |
| 7,900,608 | B2 | 3/2011 | Peters et al. | |
| 10,138,827 | B2 | 11/2018 | Dudar | |
| 2010/0224171 | A1 | 9/2010 | Peters et al. | |
| 2012/0260624 | A1* | 10/2012 | Veinbergs | F02D 41/0032 60/272 |
| 2014/0318504 | A1* | 10/2014 | Pearce | F02D 41/0045 123/518 |
| 2019/0107081 | A1 | 4/2019 | Dudar | |
| 2019/0383239 | A1* | 12/2019 | Dudar | F02M 25/0836 |

OTHER PUBLICATIONS

Birch, "Testing Audi's new e-booster reveals turbocharging's future", https://www.sae.org/news/2014/07/testing-audis-new-e-booster-reveals-turbochargings-future, Aug. 4, 2014, 4 pages.

* cited by examiner

*Primary Examiner* — George C Jin

(74) *Attorney, Agent, or Firm* — Brooks Kushman P.C.; Geoffrey Brumbaugh

(57) ABSTRACT

A vehicle system and a method of controlling the system are provided. A second check valve is positioned between and fluidly connects a canister purge valve and an ejector. A controller closes the canister purge valve and controls an electrically driven compressor to open the second check valve to remove moisture and reduce stiction after vehicle key off and during a cold soak. A vehicle system is provided with a controller to open the canister purge valve during one of a plurality of boost events associated with a vehicle driving state to open the second check valve, and open the canister purge valve in response to a subsequent one of the plurality of boost events to open the second check valve and evacuate the canister.

20 Claims, 3 Drawing Sheets

VEHICLE WITH A DUAL PATH EVAPORATIVE EMISSIONS SYSTEM

TECHNICAL FIELD

According to various embodiments, a vehicle is provided with an evaporative emissions system with a dual path purge, and a method of controlling the system.

BACKGROUND

A vehicle with a fuel tank is provided with a fuel vapor recovery system or an evaporative emissions system. The system may be periodically purged or a diagnostic may be run to verify the operational status of the system or components in the system. A valve in the purge lines may need to overcome wet stiction in the valve to provide desired purge or diagnostics of the system.

SUMMARY

According to an embodiment, a vehicle system is provided with an engine having an air intake system, a first compressor associated with the air intake system, and a second compressor positioned associated with the air intake system and driven by an electric motor. An ejector has an inlet positioned to receive compressed air from the air intake system downstream of the first and second compressors, and an outlet positioned to provide compressed air into the air intake system upstream of the first and second compressors. A canister of an evaporative emissions system is in fluid communication with a fuel tank, and a canister purge valve fluidly couples the canister to the air intake system. A first check valve is positioned between and fluidly connecting the canister purge valve and the air intake system downstream of a throttle. A second check valve is positioned between and fluidly connecting the canister purge valve and the ejector. A controller is configured to, after vehicle key off and for a specified time thereafter, close the canister purge valve and open the second check valve by running the second compressor for a predetermined time to remove moisture and reduce stiction in the second check valve.

According to another embodiment, a method of controlling a vehicle is provided. A signal indicative of a vehicle key off event is received. A canister purge valve fluidly connecting a fuel tank evaporative emissions system and an engine air intake system is closed. An electric motor is controlled to drive a compressor associated with the engine air intake system in response to receiving the signal and the canister purge valve being closed. The compressor draws a vacuum on a check valve positioned between and fluidly coupling the canister purge valve and an ejector. The compressor operation opens the check valve to remove moisture and reduce stiction in the check valve. The ejector receives compressed air from the compressor and provides compressed air into the engine air intake system upstream of the compressor.

According to an embodiment, a vehicle system is provided with an engine having an air intake system, and at least one compressor associated with the air intake system. An ejector has an inlet positioned to receive compressed air from the air intake system downstream of the at least one compressor, and an outlet positioned to provide compressed air into the air intake system upstream of the at least one compressor. A canister of an evaporative emissions system is in fluid communication with a fuel tank. A canister purge valve fluidly couples the canister to the air intake system via a first passage and a second passage, with the first passage fluidly connecting the canister purge valve to the air intake system downstream of a throttle, and the second passage fluidly connecting the canister purge valve to the ejector. A first check valve is positioned in the first passage, and a second check valve is positioned in the second passage. The second check valve is passive and opens in response to vacuum drawn by the ejector on the second check valve. A controller is configured to, in response to a vehicle driving state indicating a plurality of boost events, open the canister purge valve during one of the plurality of boost events to open the second check valve and evacuate the canister, open the canister purge valve in response to a subsequent one of the plurality of boost events to open the second check valve and evacuate the canister, and set a flag indicating evacuation of the canister after the subsequent one of the plurality of boost events.

DETAILED DESCRIPTION

As required, detailed embodiments of the present disclosure are provided herein; however, it is to be understood that the disclosed embodiments are merely examples, and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure and invention.

Figure 1:
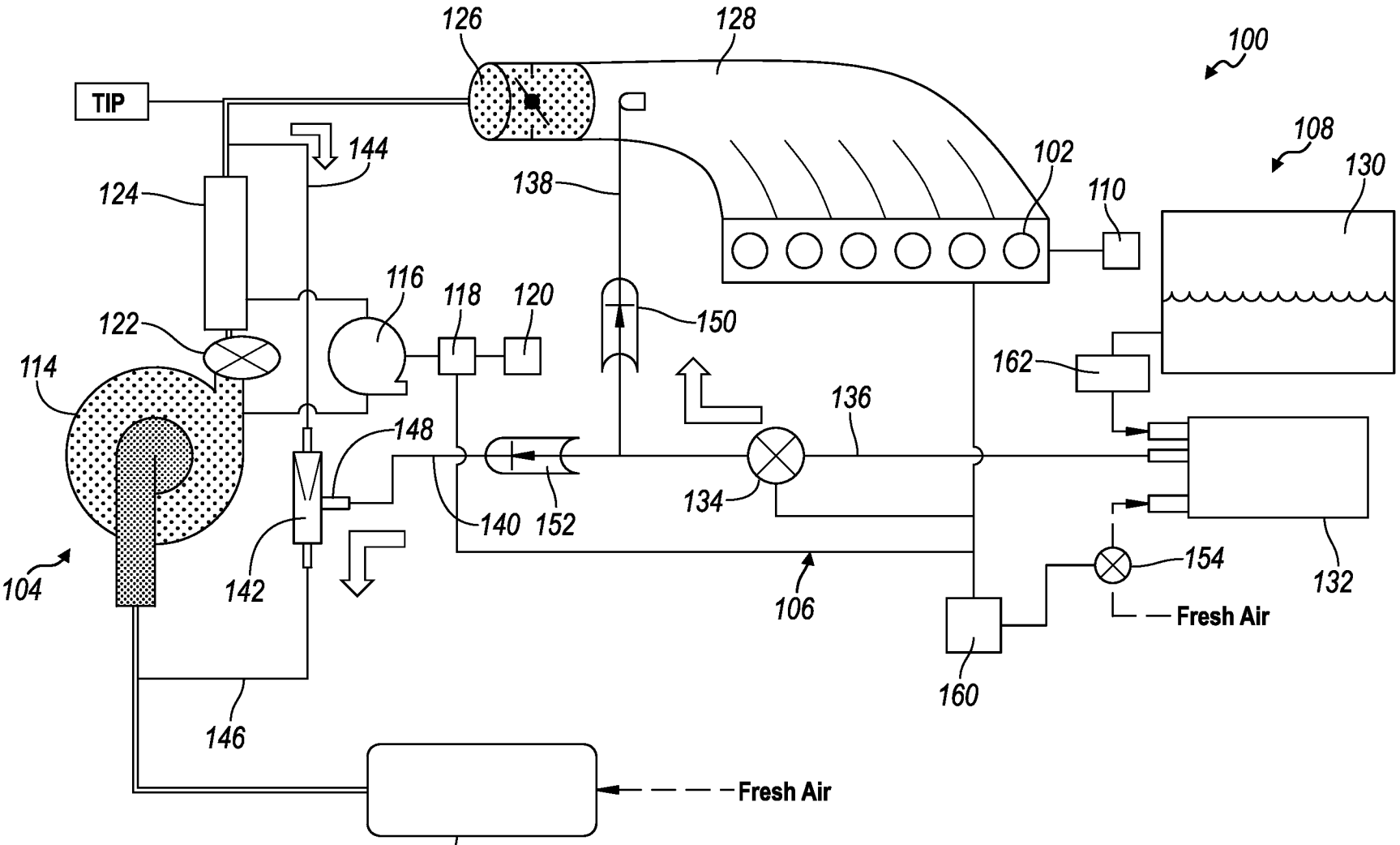
FIG. 1 illustrates a schematic of a vehicle system according to an embodiment and for use with the present disclosure.

FIG. 1 illustrates a vehicle system 100 according to an embodiment. The vehicle system 100 may be used in a vehicle with an internal combustion engine, and includes conventional gasoline, diesel, or other fuel powered vehicles, hybrid vehicles, and the like.

The vehicle system 100 has an engine 102 with an intake system 104. The vehicle system 100 also has an evaporative emissions system 106 that connects the intake system 104 to the fuel system 108.

The engine 102 is an internal combustion engine, and may be a gasoline or diesel powered engine according to various embodiments. The engine 102 combusts fuel from the fuel system 108 with air from the intake system 104 to output power to a driveline to propel the vehicle and/or drive vehicle accessory systems. The engine 102 is connected to an electric motor 110, such as a starter motor, or an electric machine for a hybrid vehicle, that is able to crank or rotate the engine unfueled.

The intake system 104 receives fresh air from the environment via an air filter 112. The intake system 104 may be a forced induction system as shown in FIG. 1, to compress the air prior to the engine. FIG. 1 illustrates a twincharger or dualcharger system with a first compressor 114 and a second compressor 116 positioned within the air intake system 104. In the example shown, the first compressor 114 is a part of a turbocharger, with the first compressor 114 mechanically driven by a turbine that is driven by engine exhaust gases. Alternatively, the first compressor 114 may be a supercharger that is mechanically driven by the engine, e.g. via the accessory drive. The second compressor 116 is a supercharger, and in the example shown, is a supercharger 116 that is connected to an electric motor 118 and battery 120, such that the second compressor 116 is electrically powered.

The electrically powered compressor 116 is used to spool up or compress the intake air faster when torque is demanded from the engine 102, and to reduce turbo lag as the second compressor 116 operates essentially without a delay to provide compressed air to the engine 102 in comparison to a mechanical turbocharger such as the first compressor 114. In some examples, the second compressor 116 may be used in limited circumstances by the vehicle system 100, for example, when a driver makes a demand for instant torque, the second compressor 116 delivers the needed boost air until the first compressor 114 is spooled up, at which point the second compressor may be turned off.

A bypass valve 122 may be positioned in the intake system to control flow of intake air through one or both of the compressors 114, 116. A charger air cooler 124 may be positioned in the intake system downstream of the first and second compressors 114, 116. From the charge air cooler 124, intake air flows to a throttle 126 for the engine, and into the intake manifold 128 for the engine.

The fuel system 108 is fluidly connected to injectors for the engine 102 to provide fuel to the engine. The fuel system 108 has a fuel tank 130. The fuel tank 130 is fluidly connected to the evaporative emissions system 106. As used herein, a fluid may include a liquid phase, a vapor phase, or a mixed phase substance.

There may be requirements for emission system components, including the fuel system 108, to be periodically tested onboard the vehicle. To reduce or prevent fuel vapors from entering the atmosphere, the fuel system 108 is provided with the evaporative emissions system 106.

The evaporative emissions system 106 has a canister 132 that is fluidly connected to a vent of the fuel tank 130. The canister 132 is filled with an absorbent material, such as activated carbon, to absorb fuel vapors. As gases containing fuel vapor pass through the absorbent material, the fuel vapor is absorbed. The fuel system 108 may be tested for integrity of the system, or can be diagnosed for leaks of evaporated fuel, by putting all or a portion of the system 108 under a vacuum and observing any change in pressure.

When a fuel tank 130 is filled, fuel vapor laden air may be displaced by the fuel. Also, daily (diurnal) temperature variations lead to lower molecular weight components of the fuel vaporizing during the heat of the day. These fuel vapors are absorbed in the canister 132. The absorbent material, such as activated carbon, has a limited ability to store fuel and, therefore, needs purging to be able to once again absorb fuel vapor displaced from the fuel tank 130. This is accomplished by periodically pulling fresh air through the carbon pellet bed within carbon canister 132 and inducting that air, which contains desorbed fuel, into an operating internal combustion engine 102. The fuel vapors that are desorbed into the incoming air are combusted in engine 102 before being exhausted, and fresh air is drawn into the canister 132. Such operation may be referred to as a purge mode because it partially or completely purges the stored fuel vapors from the canister 132.

The evaporative emissions system 106 has a canister purge valve (CPV) 134 that is positioned between and fluidly connects the canister 132 to the intake system 104. The CPV 134 receives vapor from the canister 132 via a first fluid line 136 or passage, and provides vapor to the intake system 104 via second and third fluid lines or passages 138, 140, in a duel purge configuration.

The evaporative emissions system 106 also has an ejector 142. The ejector 142 is positioned with an inlet 144 to receive air flow from the intake system downstream of the first and second compressors 114, 116, e.g. at a location between the charge air cooler 124 and the throttle 126. The ejector 142 also has an outlet 146 positioned to provide air flow back into the intake system upstream of the first and second compressors 114, 116. The ejector 142 also has a secondary inlet 148 to receive air flow from the CPV 134 and the canister via line 140.

The fluid line 138 fluidly connects the canister purge valve 134 to the intake system, for example, at a location downstream of the throttle 126 or into the intake manifold 128. A first check valve 150 is positioned within the fluid line 138 to control flow through the fluid line. The first check valve 150 may be a passive valve with an open position and a closed position. A passive valve as used herein refers to a valve with its position or operational state controlled by the fluid within the fluid line, e.g. the valve is not spring controlled, electrically controlled, or the like. An example of a passive valve is a check valve such as a flap valve, ball valve, or the like. The first check valve 150 may close in response to a boost condition, and may open in response to a vacuum condition or the engine operating without boost pressure.

The fluid line 140 fluidly connects the canister purge valve 134 to the intake system, for example, at a location upstream of the first and second compressors 114, 116 via the ejector 142. The fluid line 140 provides the secondary inlet 148 to the ejector 142. A second check valve 152 is positioned within the fluid line 140 to control flow through the fluid line. The second check valve 152 may also be a passive valve with an open position and a closed position. The second check valve 152 may open in response to a boost condition, and may close in response to a vacuum condition or the engine operating without boost pressure.

The evaporative emissions system 106 is able to purge the canister 132 under both vacuum and boost conditions. A vacuum condition exists when the first and second compressors 114, 116 are not providing compressed air or boost pressure to the engine 102, and the engine is rotating fueled or unfueled. A boost condition exists when one or both of the compressors 114, 116 are providing compressed air to the engine 102.

The canister 132 may also be connected to atmosphere via a canister vent valve 154. In other examples, the evaporative emissions system 106 may be provided without the canister vent valve 154. The canister purge valve 134 and canister vent valves 154 may each be provided as active valves, and may be controlled via a solenoid.

The vehicle system 100 may have other components, including valves, temperature or pressure sensors, or the like that are not shown for simplicity.

A controller 160 is connected to the various components of the vehicle system 100. The controller 160 may be provided as one or more controllers or control modules for the various vehicle components and systems. The controller 160 and control system for the vehicle may include any number of controllers, and may be integrated into a single controller, or have various modules. Some or all of the controllers may be connected by a controller area network (CAN) or other system. It is recognized that any controller, circuit or other electrical device disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any one or more of the electrical devices as disclosed herein may be configured to execute a computer-program that is embodied in a non-transitory computer readable medium that is programmed to perform any number of the functions as disclosed herein.

Vehicles may be required to have diagnostics to validate the integrity of fuel systems 108, such as an evaporative emissions system 106, for potential leaks, and to purge the canister 132 of the evaporative emissions system. Generally, the evaporative emissions system 106 is purged when the engine 102 is operating under vacuum or boost conditions such that the operating engine combusts the fuel vapors. The evaporative emissions system 106 provides for purging vapors from the canister 132 under both vacuum and boost conditions.

According to one example, and when a canister 132 purge is requested by the controller 160 and at least one of the compressors 114, 116 is providing compressed air to the engine 102 in a boost condition, the CPV 134 is opened, and the boosted air pressure flows through the ejector 142 and draws a vacuum that is sufficiently high on the second check valve 152 to move the second check valve 152 to the open position. The boosted air pressure in the intake manifold 128 causes the first check valve 150 to move to the closed position.

According to another example, and when a canister 132 purge is requested by the controller 160 and the engine 102 is operating in a naturally aspirated state, the CPV 134 is opened, and the vacuum in the intake manifold 128 is sufficiently high on the first check valve 150 to move the first check valve 150 to the open position, and to close the second check valve 152.

The first or second check valves 150, 152 may each be subject to stiction when moving from a closed position to an open position. Stiction is the static friction that needs to be overcome to enable relative motion of stationary objects in contact. Stiction is a threshold, and not a continuous force, and may be the force or static cohesion provided between mating surfaces of each of the check valves.

If the second check valve 152 is stuck closed, for example, due to stiction, the ejector 142 cannot draw a vacuum on the canister 132 via the second check valve 152 and CPV 134. Therefore, if the CPV 134 is opened during a boost condition, and the fuel tank pressure sensor 162 does not measure a vacuum in the fuel tank 130 or canister 132, then the second check valve 152 may be stuck in a closed position, or the boost pressure may be insufficient to overcome the stiction in the second check valve 152.

The second check valve 152 may be more likely to be stuck in a closed position due to stiction upon restart of the vehicle after an overnight or cold soak of the vehicle, or during humid weather. Water or fuel vapor may condense onto the valve seat of the second check valve 152, which may cause a stiction or suction cup effect, and make the second check valve 152 more difficult to open. The moisture during a cold soak may build up onto valve seat and sealing surfaces of the second check valve 152 and fill in any microscopic imperfections in the sealing surface for a much stronger stiction bond.

A cold soak may be defined as occurring after a vehicle shut down event or vehicle key off, where the vehicle then stays inoperative for sufficient time for the vehicle and vehicle components to reach ambient temperature. A cold soak may generate moisture or condensate from humid air and/or vapor. Upon vehicle start up or key on, and with an engine start to idle, the second check valve 152 is closed based on the engine 102 typically operating in a naturally aspirated state at idle. Once closed, the second check valve 152 may be difficult to reopen based on stiction.

The stiction caused by a wet seal in the second check valve 152 is higher than stiction cause by a dry seal in the second check valve 152, such that it may be much more difficult to break the second check valve 152 open when there is a wet stiction seal. Note that once the second check valve 152 is opened, even after a wet seal, purging the canister 132 under a boost condition may entrain and flush out the moisture in the second check valve 152 such that the second check valve 152 returns to the normal dry stiction operating state and may be easily opened.

If the second check valve 152 is stuck closed, e.g. due to wet stiction, a diagnostic of the evaporative emissions system 106 or fuel system 108 may be unable to run correctly, and a diagnostic flag may be set by the controller 160, requiring a vehicle service event. Alternatively, if the second check valve 152 is stuck closed, e.g. due to wet stiction, the canister 132 may only be able to be purged when the engine 102 is operating in a naturally aspirated state, and not when the engine 102 is operating under a boosted condition, which may unduly limit the time that the canister 132 can be purged.

The present disclosure provides for a method of controlling the vehicle and the vehicle system 100 to prevent wet stiction in the second check valve 152, reduce error in an evaporative emissions system 106 diagnostic, and facilitate purging the canister 132 under a boost condition.

Figure 2:
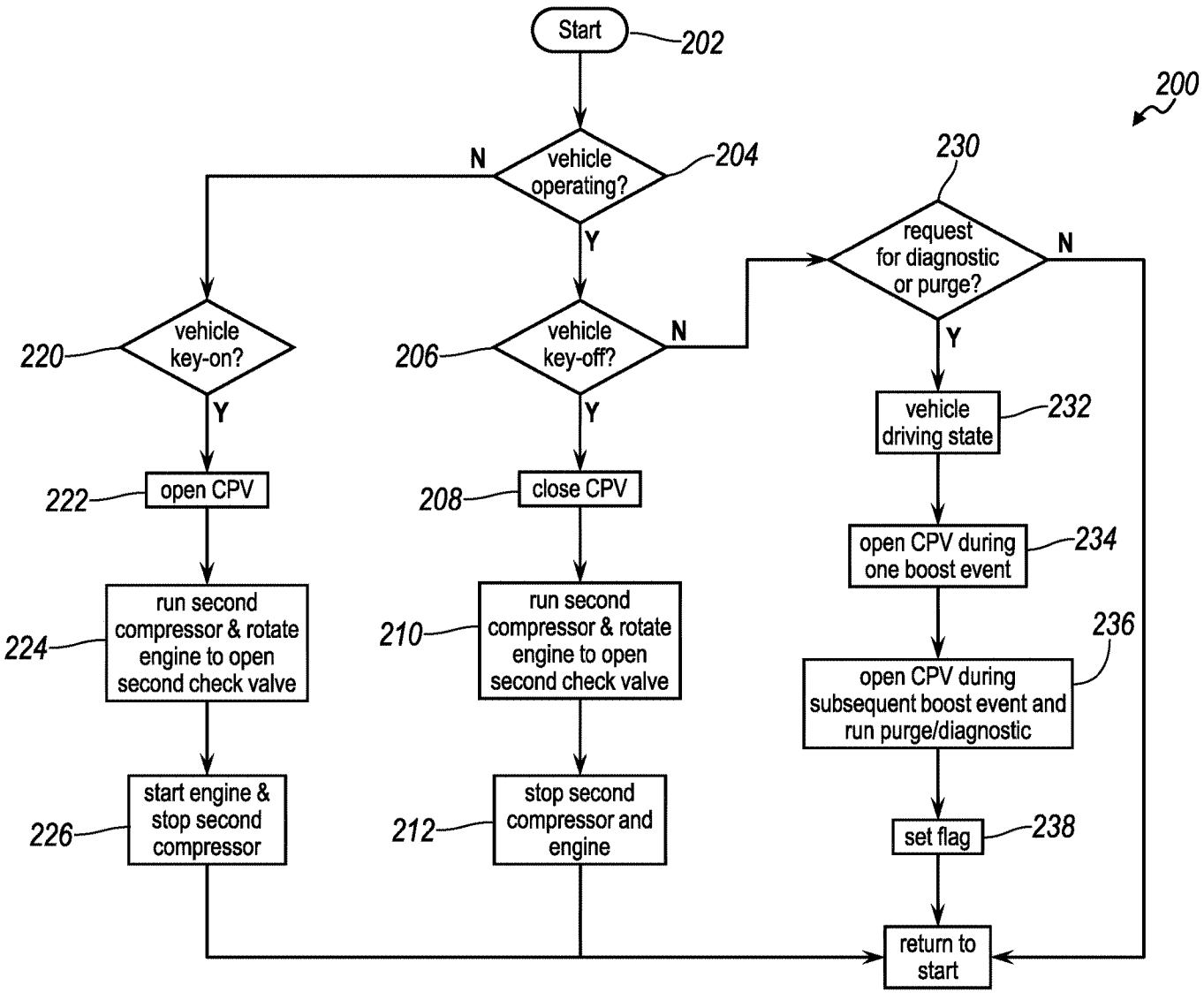
FIG. 2 illustrates a method of controlling a vehicle system according to an embodiment.

FIG. 2 illustrates a method 200 of controlling the vehicle system according to an embodiment. The method 200 may have greater or fewer steps than is shown, and steps may be performed sequentially, simultaneously, or in another order in other embodiments.

With reference to FIGS. 1 and 2, and in one example, the method 200 starts at step 202, and the controller 160 determines if the vehicle is operating at step 204.

At step 206, the controller 160 is configured to receive a signal indicative of a vehicle key off or shut down event. The second check valve 152 may be in an open position, closed position, or indeterminate position based on the state of the vacuum in the intake 104 at key off. As there may be humidity or moisture in the evaporative emissions system 106, the controller 160 proceeds to flush second check valve 152 and passage 140, and may additionally park the second check valve 152 in an open position.

At step 208, the controller 160 may close the CPV 134 or confirm that the CPV is closed, and then control the electric motor 118 to run the second compressor 116 and rotate the engine 102 unfueled for a predetermined time period at step 210. This draws a vacuum on the second check valve 152 via the ejector 142, thereby causing the second check valve 152 to open, and any moisture or vapor to be drawn out of the second check valve 152 and into the intake system 104 and engine 102. When the electric motor 118 and engine 102 rotation is stopped at step 212, the second check valve 152 remains in the open position as it is a passive valve, and is therefore parked in the open position for the remainder of the cold soak and until vehicle start up, which further reduces stiction in the second check valve 152.

In a further example, the controller 160 may additionally monitor for cold soak, and initiate step 208 prior to or during cold soak, to close the CPV 134 or confirm that the CPV is closed, control the electric motor 118 to run the second compressor and rotate the engine 102 unfueled for a predetermined time period. After vehicle shut down and for a specified time thereafter, the controller 160 may close the CPV 134 or confirm that the CPV is closed, control the electric motor 118 to run the second compressor and rotate the engine 102 unfueled for a predetermined time period. Furthermore, if the fuel system 108 has a vapor blocking valve in the line connecting the fuel tank 130 to the canister 132, this valve may additionally be commanded closed to further limit pulling fuel vapor from the fuel tank when the engine and vehicle are off. Note that unless the method 200 is provided, the second check valve 152 is conventionally parked or left in a closed position at vehicle shut down and key off as the engine 102 is operating in a naturally aspirated mode with no boost pressure and with the intake under a vacuum condition.

Figure 3:
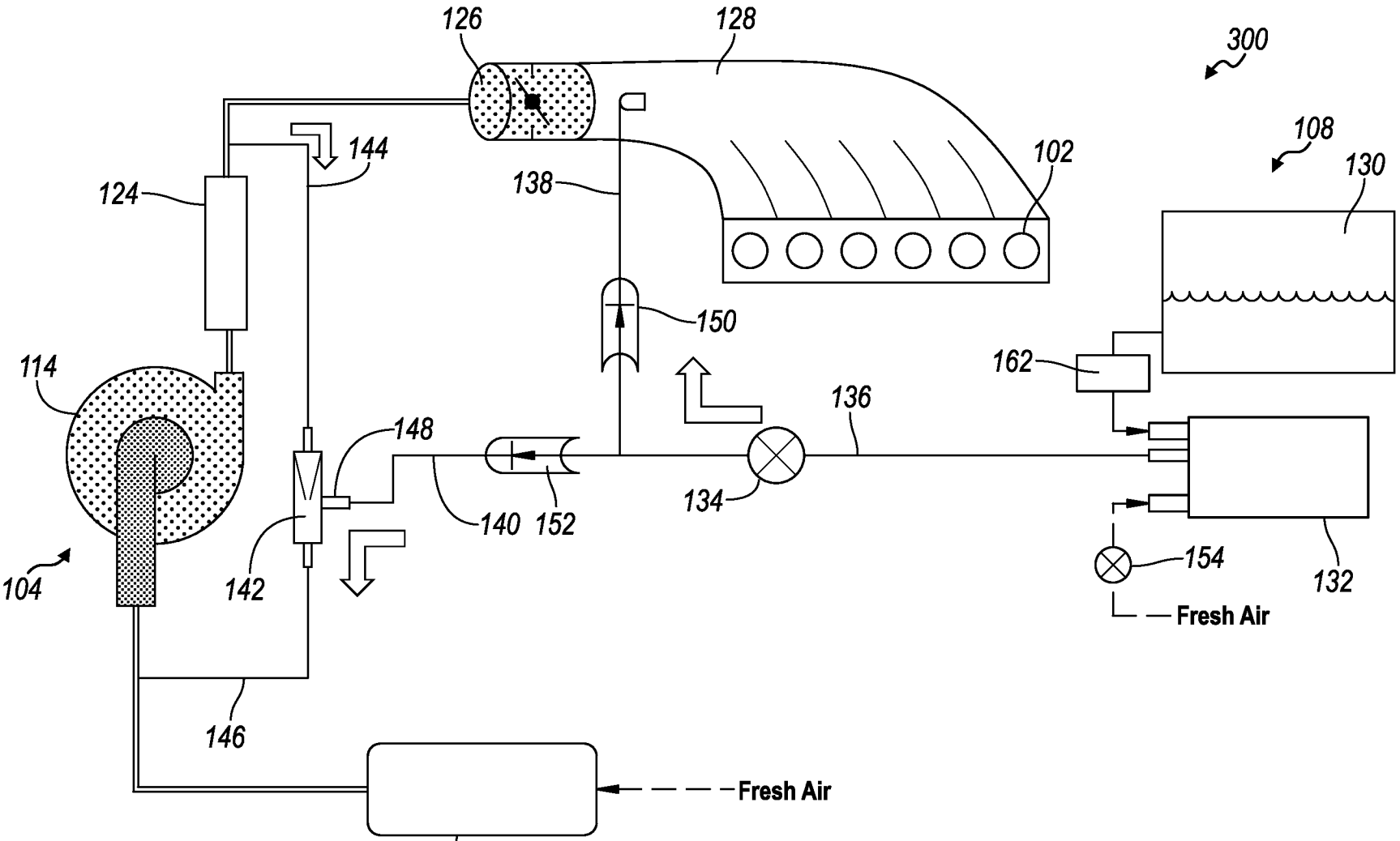
FIG. 3 illustrates a schematic of another vehicle system according to an embodiment and for use with the present disclosure.

In a further example, the vehicle systems of FIGS. 1 and 3 may be provided with a hydrocarbon trap positioned in the air intake system 104, for example, downstream of the inlet passage 144 to the ejector 142. In this case, and at or after vehicle key off, the controller 160 may control the electric motor 118 to run the second compressor 116 and open the second check valve 152 to verify a vacuum in the canister 132 prior to closing the CPV 134.

At step 220, the controller 160 is configured to receive a signal indicative of a vehicle key on or start up event. The second check valve 152 may be in an open position, closed position, or indeterminate position based on the state of the vacuum in the intake 104 at key on. As there may be humidity or moisture in the evaporative emissions system 106, the controller 160 proceeds to flush second check valve 152 and passage 140 prior to cranking or starting the engine 102, thereby removing moisture that may have collected during a cold soak.

At step 222, the controller 160 may open the CPV 134 or confirm that the CPV is open. At step 224, the controller 160 then controls the electric motor 118 to run the second compressor 116 and rotate the engine 102 unfueled for a predetermined time period. This draws a vacuum on the second check valve 152 via the ejector 142, thereby causing the second check valve 152 to open, and any moisture or vapor to be drawn out of the second check valve 152 and into the intake system 104 and engine 102. At step 226, after a predetermined time period, the engine 102 is then started with fuel and operates to idle, and the electric motor 118 and second compressor 116 are stopped. The second check valve 152 closes at engine idle, as the engine 102 is operating in a naturally aspirated mode with the intake 104 under a vacuum condition. However, as moisture has been removed from the second check valve 152, a dry seal is formed when it closes, which has reduced stiction in comparison to a wet seal in the valve 152 such that it opens easily during a boost condition for a evaporative systems 106 or fuel system 108 diagnostic or for canister 132 purge.

Note that a diagnostic for an evaporative emissions system 106 or fuel system 108 may disregard a first diagnostic result in order to avoid a false flag being set by a second check valve 152 that is closed due to wet stiction. A false flag may impact the control strategy for canister 132 purge. In certain operating conditions, e.g. mild drive cycles with limited boost time, it may be desirable to not disregard the first diagnostic result. Furthermore, there may be emissions standards that make it desirable to not disregard the first diagnostic result, such as the CARB In Use Monitoring Performance (IUMP).

Using the second compressor 116 to flush moisture from the second check valve 152 at or after vehicle key off or vehicle key on events may therefore improve the emissions or fuel systems 106, 108 diagnostic. Furthermore, wet stiction is reduced in the second check valve 152, which maintains the ability to purge the canister 132 under a boost condition, as the boost pressure ensuring vacuum drawn on the second check valve 152 may be sufficient to open a second check valve 152 with a dry seal, but may be insufficient to open the second check valve 152 that has a wet seal or wet stiction.

FIG. 3 illustrates a vehicle system according to another embodiment. Elements that are the same as or similar to those described in FIG. 1 are given the same reference number as those described above for simplicity. The vehicle system of FIG. 3 has only a single compressor, which may be a mechanically driven turbocharger as described above, or a supercharger. When the vehicle system does not have an electrically driven compressor, as is shown in FIG. 3, the controller is unable to flush the second check valve after vehicle shut down.

In further examples for the method 200 of FIG. 2, and with reference to FIGS. 1 and 3 above, the evaporative emissions system 106 may be provided without a canister vent valve 154 and/or without a fuel tank pressure sensor 162. Therefore, a diagnostic may not be readily available to test the second check valve 152 to determine if it is functioning or detect that it is open. If the operational status of the second check valve 152 is unknown, and the second check valve 152 is stuck closed, the controller 160 may initiate a purge of the canister 132 under a boost condition that does not actually purge the canister 132 as there is no fluid flow through the second check valve 152. The present disclosure provides a method 200 to precondition the second check valve 152 to open prior to a diagnostic or purge event.

Therefore, for evaporative emissions systems 106 without the canister vent valve 154, the controller 160 may precondition the second check valve 152 to an open position prior to a purge event or a diagnostic event under boost.

At step 230, the controller 160 determines that there is a request for a purge event or a diagnostic of the evaporative emissions system 106 or fuel system 108.

At step 232, the controller 160 may determine that the vehicle is operating in a vehicle driving state or drive cycle that indicates a likelihood of a plurality of boost events during that vehicle driving state. A vehicle driving state that indicates a likelihood of a plurality of boost events may be, for example, a long hill climb, a trailer or tow haul mode, or the like.

At step 234, and in response to determining that there is a vehicle driving state indicating a plurality of boost events, the controller 160 opens the canister purge valve 134 during one of the plurality of boost events to open the second check valve 152. At step 236, the controller 160 opens the canister purge valve 134 in response to a subsequent one of the plurality of boost events during the vehicle driving state to reopen the second check valve 152 and evacuate the canister 132 or run the diagnostic. The controller 160 then sets a flag indicating evacuation of the canister or completion of the diagnostic after the subsequent one of the plurality of boost events at step 238.

In other examples, the vehicle systems 100, 300 of FIGS. 1 and 3 with a canister vent valve 154 may also implement a control strategy with purging the canister 132 on a second boost event at step 236, and after preconditioning the second check valve 152 to an open position at step 234 as described above.

Likewise, the vehicle systems 100, 300 of FIGS. 1 and 3, with or without a canister vent valve 154 may implement a control strategy with running the diagnostic of the evaporative emissions system on a second or subsequent boost event during the vehicle driving state at step 236, and after preconditioning the second check valve to an open position at step 234 as described above.

The control strategy described above may also be used to purge the canister 132 on a second boost event with the vehicle system 300 of FIG. 3 without an electrically driven compressor 116, and after preconditioning the second check valve 152 to an open position at step 234. This may be useful to open the second check valve 152 as the vehicle system 300 in FIG. 3 may be unable to control the second check valve to an open position at a vehicle shut down event via steps 208-212 as there is no electrically driven compressor to provide a boost event.

Furthermore, and with reference to the descriptions above, when running the electric compressor 116 to open the second check valve 152, the controller 160 may control the canister vent valve 154 to be in a closed position or an open position, for example, based on a pressure in the fuel tank 130 or canister 132, or other inputs or states.

While exemplary embodiments are described above, it is not intended that these embodiments describe all possible forms of the disclosure or invention. Rather, the words used in the specification are words of description rather than limitation, and it is understood that various changes may be made without departing from the spirit and scope of the disclosure. Additionally, the features of various implementing embodiments may be combined to form further embodiments of the invention.

What is claimed is:

1. A vehicle system comprising:

an engine having an air intake system;

a first compressor associated with the air intake system;

a second compressor associated with the air intake system and driven by an electric motor;

an ejector having an inlet positioned to receive compressed air from the air intake system downstream of the first and second compressors, and an outlet positioned to provide compressed air into the air intake system upstream of the first and second compressors;

a canister of an evaporative emissions system in fluid communication with a fuel tank;

a canister purge valve fluidly coupling the canister to the air intake system;

a first check valve positioned between and fluidly connecting the canister purge valve and the air intake system downstream of a throttle;

a second check valve positioned between and fluidly connecting the canister purge valve and the ejector; and a controller configured to, after vehicle key off and for a specified time thereafter, close the canister purge valve and open the second check valve by running the second compressor for a predetermined time period to remove moisture and reduce stiction in the second check valve.

2. The vehicle system of claim 1 wherein the controller is further configured to rotate the engine unfueled after a vehicle shut down event and for the specified time thereafter, open the second check valve while running the second compressor for the predetermined time period.

3. The vehicle system of claim 1 wherein the second check valve is a passive valve.

4. The vehicle system of claim 1 further comprising a hydrocarbon trap associated with the air intake system; and wherein the controller is configured to, after the vehicle key off and for the specified time thereafter, and prior to closing the canister purge valve, verify a vacuum in the canister by running the second compressor to open the second check valve.

5. The vehicle system of claim 1 wherein the controller is further configured to, after the predetermined time period, stop the electric motor and compressor with the second check valve maintained in an open position.

6. The vehicle system of claim 1 wherein the controller is further configured to, in response to vehicle key on and while rotating the engine unfueled, open the canister purge valve, and open the second check valve by running the second compressor to remove moisture and reduce stiction in the second check valve.

7. The vehicle system of claim 6 wherein the controller is further configured to start the engine a predetermined time period after the vehicle key on and running the second compressor, wherein the second check valve is closed in response to the engine reaching idle.

8. The vehicle system of claim 1 further comprising a canister vent valve directly fluidly coupling the canister to atmosphere.

9. The vehicle system of claim 8 wherein the controller is further configured to after the vehicle key off and for the specified time thereafter, open the canister vent valve when closing the canister purge valve and running the second compressor to open the second check valve.

10. The vehicle system of claim 1 wherein the canister is provided without a canister vent valve directly fluidly coupling the canister to atmosphere.

11. The vehicle system of claim 1 wherein the controller is further configured to, in response to a vehicle driving state indicating a plurality of boost events, open the canister purge valve during one of the plurality of boost events to open the second check valve and evacuate the canister, open the canister purge valve in response to a subsequent one of the plurality of boost events to open the second check valve and evacuate the canister, and set a flag indicating evacuation of the canister after the subsequent one of the plurality of boost events.

12. The vehicle system of claim 11 wherein the canister is provided without a canister vent valve directly fluidly coupling the canister to atmosphere.

13. A method of controlling a vehicle, the method comprising:

receiving a signal indicative of a vehicle key off event;

closing a canister purge valve fluidly connecting a fuel tank evaporative emissions system and an engine air intake system; and controlling an electric motor to drive a compressor associated with the engine air intake system in response to receiving the signal and the canister purge valve being closed, wherein the compressor draws a vacuum on a check valve positioned between and fluidly coupling the canister purge valve and an ejector, wherein the compressor operation opens the check valve to remove moisture and reduce stiction in the check valve, wherein the ejector receives compressed air from the compressor and provides compressed air into the engine air intake system upstream of the compressor.

14. The method of claim 13 wherein the electric motor is controlled to drive the compressor associated with the engine air intake system in response to receiving the signal and the canister purge valve being closed, and during a cold soak of the vehicle.

15. The method of claim 13 wherein the check valve is a first check valve; and wherein controlling the electric motor to drive the compressor in response to receiving the signal and the canister purge valve being closed draws a vacuum on a second check valve positioned between and fluidly coupling the canister purge valve and an intake manifold of the engine air intake system, wherein the compressor operation closes the second check valve.

16. The method of claim 13 further comprising rotating an engine unfueled after the vehicle key off event and during a cold soak, while controlling the electric motor to run the compressor thereby opening the check valve.

17. The method of claim 13 further comprising receiving another signal indicative of a vehicle key on event;

opening the canister purge valve;

in response to receiving the another signal and the canister purge valve being open, controlling the electric motor to drive the compressor and rotating an engine unfueled, wherein the compressor operation opens the check valve to remove moisture and reduce stiction in the check valve; and start the engine a predetermined time period after the vehicle key on and running the compressor, wherein the check valve is closed in response to the engine reaching idle.

18. The method of claim 13 further comprising, in response to a vehicle driving state indicating a plurality of boost events, opening the canister purge valve during one of the plurality of boost events to open the check valve and evacuate a canister of the fuel tank evaporative emissions system, opening the canister purge valve in response to a subsequent one of the plurality of boost events to open the check valve and evacuate the canister, and setting a flag indicating evacuation of the canister after the subsequent one of the plurality of boost events.

19. The method of claim 18 wherein the fuel tank evaporative emissions system is provided without a canister vent valve fluidly coupling a canister of the fuel tank evaporative emissions system to atmosphere.

20. A vehicle system comprising:

an engine having an air intake system;

at least one compressor associated with the air intake system;

an ejector having an inlet positioned to receive compressed air from the air intake system downstream of the at least one compressor, and an outlet positioned to provide compressed air into the air intake system upstream of the at least one compressor;

a canister of an evaporative emissions system in fluid communication with a fuel tank;

a canister purge valve fluidly coupling the canister to the air intake system via a first passage and a second passage, the first passage fluidly connecting the canister purge valve to the air intake system downstream of a throttle, and the second passage fluidly connecting the canister purge valve to the ejector;

a first check valve positioned in the first passage;

a second check valve positioned in the second passage, wherein the second check valve is passive and opens in response to vacuum drawn by the ejector on the second check valve; and a controller configured to, in response to a vehicle driving state indicating a plurality of boost events, open the canister purge valve during one of the plurality of boost events to open the second check valve and evacuate the canister, open the canister purge valve in response to a subsequent one of the plurality of boost events to open the second check valve and evacuate the canister, and set a flag indicating evacuation of the canister after the subsequent one of the plurality of boost events.

* * * * *